US007694389B2

(12) United States Patent
Erickson et al.

(10) Patent No.: US 7,694,389 B2
(45) **Date of Patent: *Apr. 13, 2010**

(54) VERTICALLY ADJUSTABLE HINGE

(75) Inventors: Gary M. Erickson, Lena, IL (US); Scott J. Rote, New Lenox, IL (US); Scott Zeeb, Chicago, IL (US); Todd K. Ellerton, Roscoe, IL (US); Michael D. Smith, Winnebago, IL (US)

(73) Assignee: Newell Operating Company, Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/035,973

(22) Filed: Feb. 22, 2008

(65) Prior Publication Data

US 2008/0209679 A1 Sep. 4, 2008

Related U.S. Application Data

(63) Continuation of application No. 11/058,884, filed on Feb. 16, 2005, now Pat. No. 7,334,293.

(51) Int. Cl.
*E05D 7/04* (2006.01)

(52) U.S. Cl. ..... 16/243; 16/245

(58) Field of Classification Search ..... 16/243–247, 16/239–242, 235–237, 250, 251, 382, 387; 75/424.6, 424.7, 425, 89.13, 89.14, 89.17; 403/22–25; 411/407, 402, 919

See application file for complete search history.

(56) References Cited

U.S. PATENT DOCUMENTS 375,038 A 12/1887 Wright
375,039 A 12/1887 Wright
386,186 A 7/1888 Dahlman
442,547 A 12/1890 Radler
794,454 A 7/1905 Davis et al.
843,081 A 2/1907 Fitgerald
863,128 A 8/1907 Aebi
880,317 A 2/1908 Ven De Marwitz
928,760 A 7/1909 Hunter
1,002,394 A 9/1911 Hanson
1,111,832 A 9/1914 Hazelrigg et al.
1,214,263 A 1/1917 Barber
1,314,732 A 9/1919 Cochran et al.
1,341,063 A 5/1920 McQueen (Continued)

*Primary Examiner*—Chuck Y. Mah
(74) *Attorney, Agent, or Firm*—Banner & Witcoff, Ltd

(57) ABSTRACT

A vertically adjustable hinge is disclosed. The hinge comprises a housing for attachment to a first structure. The housing has a housing cavity and an opening into the cavity. The cavity has an upper portion, a lower portion and a retaining portion forming a channel defining the upper portion and the lower portion. The hinge further includes a first leaf extending through the cavity opening and into the cavity upper portion, threaded nut rotationally fixed to the first leaf, and an adjustment mechanism disposed in the housing cavity. The adjustment mechanism comprises a jack screw extending between the upper cavity portion and the lower cavity portion. The jack screw has a threaded portion threadably engaging the nut in the upper cavity portion and a geared portion disposed in the cavity lower portion. The hinge further includes a worm gear engaging the jack screw geared portion, wherein rotation of the worm gear rotates the jack screw threaded portion in the nut, thereby moving the first leaf relative to the housing.

21 Claims, 2 Drawing Sheets

U.S. PATENT DOCUMENTS 1,632,383 A * 6/1927 Seiden et al. ..... 248/188.4
2,373,955 A 4/1945 Fuller
2,474,311 A 6/1949 Graham
2,588,258 A 3/1952 Lowman
2,683,279 A 7/1954 Okerlund et al.
2,913,200 A 11/1959 Paine, Jr. et al.
2,940,115 A 6/1960 Hansen
3,423,786 A 1/1969 Arias, Jr. et al.
3,475,784 A 11/1969 Faltx
3,584,332 A 6/1971 Taylor
3,613,150 A 10/1971 Osborn
3,618,993 A 11/1971 Platte
4,106,158 A 8/1978 Kellems et al.
4,141,109 A 2/1979 Farrell
4,142,272 A 3/1979 Oogami et al.
4,304,027 A 12/1981 Di Fazio
4,330,901 A 5/1982 Sanders
4,386,646 A 6/1983 Maryas
4,434,523 A 3/1984 Grass
4,493,129 A 1/1985 Grass
4,571,774 A 2/1986 Hinson
4,590,642 A 5/1986 Hesener
4,639,971 A 2/1987 Kurtz
4,918,783 A * 4/1990 Chu ..... 16/19
5,295,756 A * 3/1994 Ohta ..... 403/11
5,694,665 A * 12/1997 Strickland et al. ..... 16/238
5,713,105 A 2/1998 Toomey
6,571,660 B2 * 6/2003 Gmurowski et al. ..... 74/512
6,715,181 B1 4/2004 Fries
7,331,085 B2 2/2008 Heid
7,334,293 B2 2/2008 Erickson et al.
2003/0136887 A1 * 7/2003 Gabriel ..... 248/188.2
2005/0188500 A1 9/2005 Heid
2006/0179610 A1 8/2006 Erickson et al.

* cited by examiner

VERTICALLY ADJUSTABLE HINGE

CROSS-REFERENCE TO RELATED APPLICATIONS

The present application is a continuation of U.S. patent application No. 11/058,884 (filed Feb. 16, 2005), issued as U.S. Pat. No. 7,334,293 (issued on Feb. 26, 2008), and claims the benefit thereof.

FEDERALLY SPONSORED RESEARCH OR DEVELOPMENT

Not Applicable.

TECHNICAL FIELD

The present invention relates to a vertically adjustable hinge, such as for mounting a door to a door frame.

BACKGROUND OF THE INVENTION

Various vertically adjustable hinges have been provided. See, for example, Green et al., U.S. Pat. No. 5,755,011; Killingstad, U.S. Pat. No. 4,825,507; MacIntyre, U.S. Pat. No. 5,339,493; Jahnke, U.S. Pat. No. 5,701,636; and Toomey, U.S. Pat. No. 5,713,105.

DETAILED DESCRIPTION OF A PREFERRED EMBODIMENT

Figure 1:
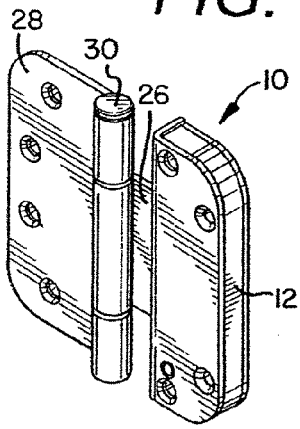
FIG. 1 is a perspective view of a vertically adjustable hinge according to the present invention.
Figure 2:
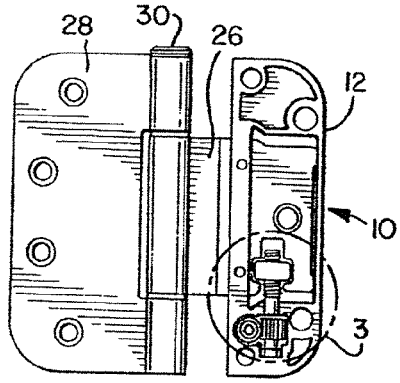
FIG. 2 is a front view of the hinge of FIG. 1, with cover plate removed and exposing an adjustment mechanism.
Figure 3:
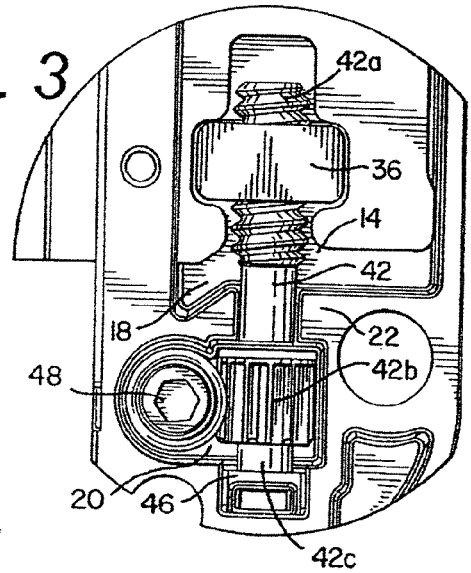
FIG. 3 is a detail of FIG. 2.
Figure 4:
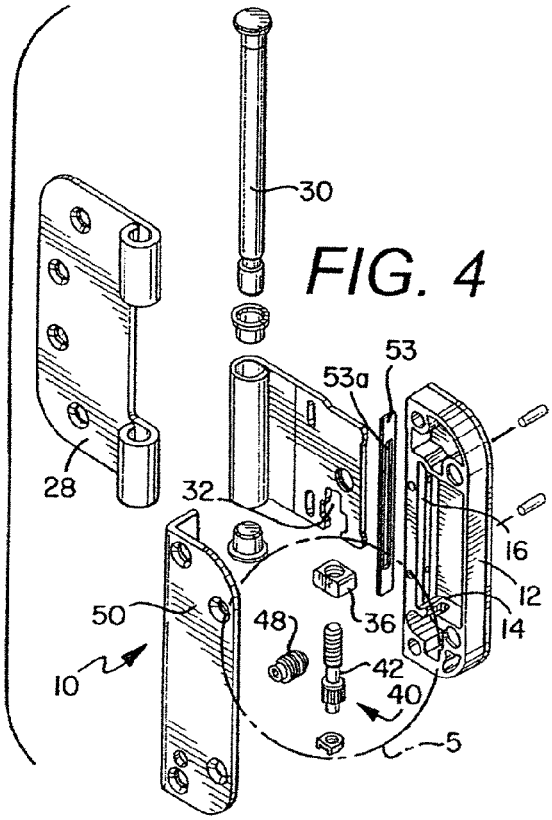
FIG. 4 is an exploded view of the adjustable hinge of FIG. 1.
Figure 5:
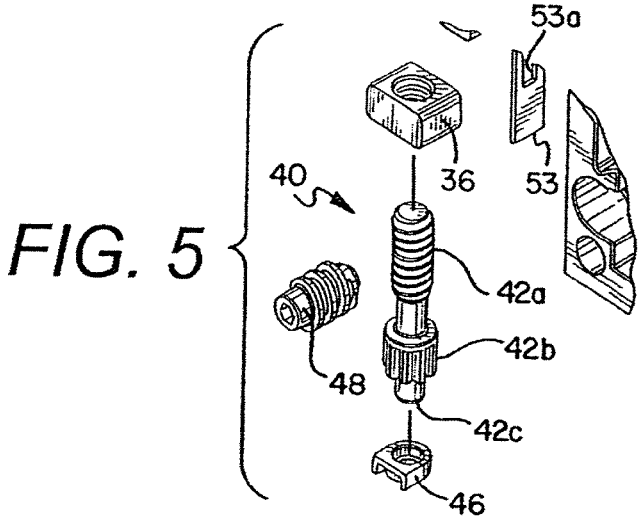
FIG. 5 is a detail of FIG. 4.

While this invention is susceptible of embodiments in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiments illustrated.

A vertically adjustable hinge 10 is illustrated in FIGS. 1-6. The hinge 10 includes a housing 12 for attachment in a conventional manner to a first structure, such as a door (not shown). The housing 12 has a housing cavity 14 and an opening 16 into the cavity 14. The cavity has an upper portion 18, a lower portion 20 and a retaining portion 22. The retaining portion 22 forms a channel defining the upper portion 18 and the lower portion 20.

The hinge 10 further includes a first leaf 26 extending through the cavity opening 16 and into the cavity upper portion 18. Additionally, the hinge 10 includes a conventional second leaf 28 for attachment to a second structure, such as a door frame (not shown). The first leaf 26 is coupled to the second leaf 28 in a conventional manner by a hinge pin 30.

The first leaf 26 has a generally t-shaped slot 32 having a vertical leg and a horizontal leg. A threaded nut 36 is rotationally fixed in the t-shaped slot horizontal leg.

The hinge 10 further includes a vertical adjustment mechanism 40 disposed in the housing cavity 14. The adjustment mechanism 40 comprises a jack screw 42 receiveably supported by the retaining portion 22 and extending between the upper cavity portion 18 and the lower cavity portion 20. The retaining portion 22 limits axial movement of the jack screw 42.

The jack screw 42 has a threaded portion 42*a* threadably engaging the nut 36 in the upper cavity portion 18 and a geared portion 42*b* disposed in the cavity lower portion 20. The jack screw 42 includes a tip portion 42*c* opposite the threaded portion 42*a*. The hinge 10 includes a bearing cup 46 to receive the tip portion 42*c*.

The adjustment mechanism 40 includes a worm gear 48 engaging the jack screw geared portion 42*b*. Rotation of the worm gear 48 rotates the jack screw threaded portion 42*b* in the nut 36, thereby moving the first leaf 26 relative to the housing 12.

The housing 12 includes a cover plate 50 having an opening 50*a* exposing the worm gear 48, to permit access to rotate the worm gear 48.

Figure 6:
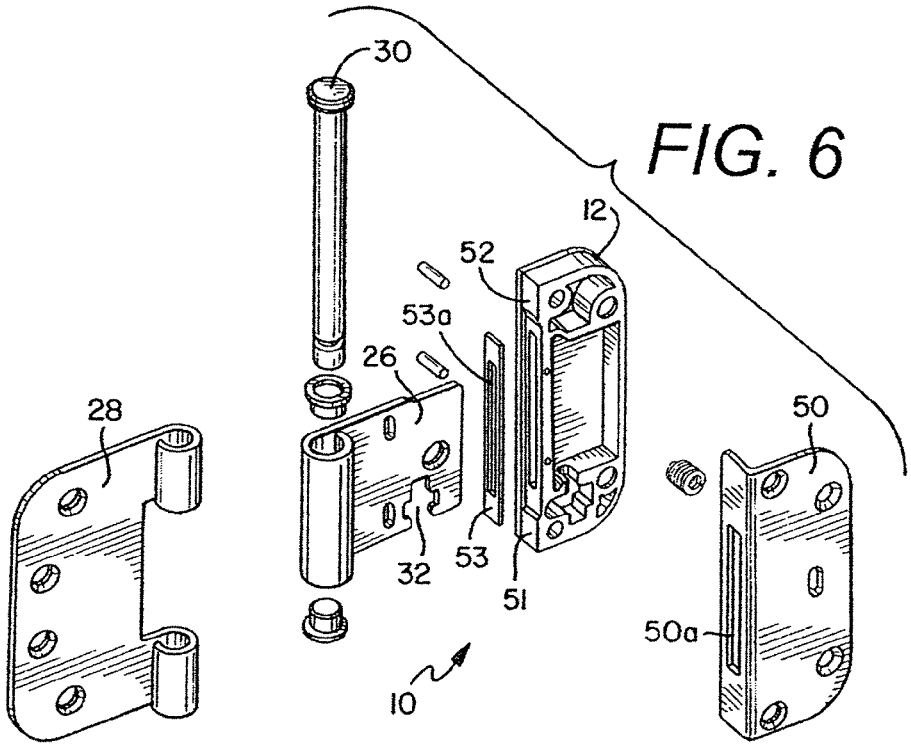
FIG. 6 is an exploded view of the adjustable hinge of FIG. 1.

Referring specifically to FIG. 6, the housing 12 further includes a housing face 51 having a recess 52 and a face opening 53 through the recess 52. A slotted plate 53 is disposed in the recess 52, and is movable relative to the recess 52. The slotted plate 53 is preferably plastic, although it could be of metal or other suitable materials. The slotted plate 53 has a slot 53*a* which receives the first leaf 26. The slot 53*a* is dimensioned substantially the same as the leaf 26 to provide a relatively snug fit there between.

With conventional adjustable hinges, whether vertically adjustable, horizontally adjustable, or both, the cavity opening 16 into the housing cavity 14 must be larger than the respective cross-section of the leaf 26, to permit the leaf 26 to adjustably move relative to the housing 12. This resulted in an undesirable appearance and permitted entrance of contaminants into the cavity 14. In the present adjustable hinge 10, the slotted plate 53 moves in the recess 52 with the first leaf 26, thereby keeping the cavity opening 16 covered and presenting an aesthetically clean appearance. While this feature has been illustrated with respect to a vertically adjustable hinge, it should be understood that it is equally applicable to a horizontally adjustable hinge as well as to a hinge both horizontally and vertically adjustable.

While the specific embodiment has been illustrated and described, numerous modifications come to mind without significantly departing from the spirit of the invention, and the scope of protection is only limited by the scope of the accompanying claims.

What is claimed is:

1. An assembly comprising:

a housing having a cavity adapted for receiving a leaf therein and a cavity opening adapted to receive the leaf therethrough to permit the leaf to extend into the cavity, the housing further comprising a slotted plate disposed over the cavity opening, the slotted plate having a slot adapted to receive the leaf therethrough;

a threaded nut positioned at least partially within the housing such that the nut is fixed against rotation with respect to the housing, wherein the threaded nut is adapted to engage the leaf when the leaf is received in the cavity;

a screw having a threaded portion and a geared portion, the threaded portion threadably engaging the nut; and a gear member engaging the geared portion of the screw and adapted to be manipulated by a user, wherein rotation of the gear member causes rotation of the screw, and rotation of the screw moves the threaded nut axially within the housing, wherein movement of the threaded nut is adapted to move the leaf within the cavity.

2. The assembly of claim 1, further comprising the leaf, wherein the leaf is received in the cavity and the threaded nut engages the leaf, and wherein movement of the threaded nut moves the leaf within the cavity.

3. The assembly of claim 2, wherein the leaf comprises a generally t-shaped slot having a vertical leg and a horizontal leg, the nut being received in the horizontal leg, wherein the nut engages the slot to prevent rotation of the nut with respect to the leaf.

4. The assembly of claim 1, wherein the housing cavity comprises an upper portion, a lower portion, and a retaining portion, wherein the nut is positioned in the upper portion, the gear member is positioned in the lower portion, and the retaining portion is dimensioned to limit axial movement of the screw.

5. The assembly of claim 1, wherein the screw has a tip portion opposite the threaded portion, and wherein the housing further comprises a bearing tip receiving the tip portion.

6. The assembly of claim 1, wherein the gear member has an axis of rotation that is generally perpendicular to an axis of rotation of the screw.

7. The assembly of claim 1, wherein the gear member has an axis of rotation that is offset from an axis of rotation of the screw.

8. The assembly of claim 1, wherein the gear member is a worm gear.

9. The assembly of claim 1, wherein the housing has an opening exposing a portion of the gear to permit access by the user to rotate the gear.

10. The assembly of claim 1, wherein the slotted plate is moveable relative to the housing.

11. An assembly comprising:

a housing having a cavity therein;

a first leaf for insertion into the cavity;

a second leaf pivotably connected to the first leaf to form a hinge;

a threaded nut positioned at least partially within the housing such that the nut is fixed against rotation with respect to the housing, wherein the threaded nut engages the first leaf when the first leaf is received in the cavity;

a screw having a threaded portion and a geared portion, the threaded portion threadably engaging the nut; and a gear member engaging the geared portion of the screw and adapted to be manipulated by a user, wherein rotation of the gear member causes rotation of the screw, and rotation of the screw moves the threaded nut axially within the housing, thereby moving the first leaf within the cavity.

12. The assembly of claim 11, wherein the first leaf comprises a generally t-shaped slot having a vertical leg and a horizontal leg, the nut being received in the horizontal leg, wherein the nut engages the slot to prevent rotation of the nut with respect to the first leaf.

13. The assembly of claim 11, wherein the housing cavity comprises an upper portion, a lower portion, and a retaining portion, wherein the nut is positioned in the upper portion, the gear member is positioned in the lower portion, and the retaining portion is dimensioned to limit axial movement of the screw.

14. The assembly of claim 11, wherein the screw has a tip portion opposite the threaded portion, and wherein the housing further comprises a bearing tip receiving the tip portion.

15. The assembly of claim 11, wherein the housing further has a cavity opening receiving the first leaf therethrough to permit the first leaf to extend into the cavity, the housing further comprising a slotted plate disposed over the cavity opening, the slotted plate having a slot receiving the first leaf therethrough.

16. The assembly of claim 11, wherein the gear member has an axis of rotation that is generally perpendicular to an axis of rotation of the screw.

17. The assembly of claim 11, wherein the gear member has an axis of rotation that is offset from an axis of rotation of the screw.

18. The assembly of claim 11, wherein the gear member is a worm gear.

19. The assembly of claim 11, wherein the housing has an opening exposing a portion of the gear member to permit access by the user to rotate the gear member.

20. An assembly comprising:

a housing having a cavity and a cavity opening therein;

a leaf extending through the cavity opening and into in the cavity in an insertion direction;

a threaded nut engaging the leaf within the cavity such that the nut is fixed against rotation with respect to the leaf, wherein the threaded nut is adapted to engage the leaf when the leaf is received in the cavity;

a screw having a threaded portion and a geared portion, the threaded portion threadably engaging the nut; and a gear member engaging the geared portion of the screw and adapted to be manipulated by a user, wherein rotation of the gear member causes rotation of the screw, and rotation of the screw moves the threaded nut axially within the housing in a second direction transverse to the insertion direction, wherein movement of the threaded nut moves the leaf in the second direction within the cavity.

21. An assembly comprising:

a housing having a cavity;

a leaf received in the cavity, the leaf comprising a generally t-shaped slot having a vertical leg and a horizontal leg;

a threaded nut positioned at least partially within the housing such that the nut is fixed against rotation with respect to the housing, wherein the threaded nut engages the leaf when the leaf is received in the cavity such that the nut is received in the horizontal leg of the slot of the leaf, and the nut engages the slot to prevent rotation of the nut with respect to the leaf a screw having a threaded portion and a geared portion, the threaded portion threadably engaging the nut; and a gear member engaging the geared portion of the screw and adapted to be manipulated by a user, wherein rotation of the gear member causes rotation of the screw, and rotation of the screw moves the threaded nut axially within the housing, wherein movement of the threaded nut moves the leaf within the cavity.

* * * * *